US005500059A

United States Patent [19]

Lund et al.

[11] Patent Number: 5,500,059

[45] **Date of Patent: *Mar. 19, 1996**

[54] ANHYDROUS 5-AMINOTETRAZOLE GAS GENERANT COMPOSITIONS AND METHODS OF PREPARATION

[75] Inventors: Gary K. Lund, Malad, Id.; Reed J. Blau, Richmond, Utah

[73] Assignee: Thiokol Corporation, Ogden, Utah

[ * ] Notice: The portion of the term of this patent shall not extend beyond the expiration date of Pat. No. 5,472,647.

[21] Appl. No.: 437,867

[22] Filed: May 9, 1995

Related U.S. Application Data

[63] Continuation-in-part of Ser. No. 101,396, Aug. 2, 1993.

[51] Int. Cl.[6] ..... C06B 45/10

[52] U.S. Cl. ..... 149/19.1; 149/61; 149/70; 149/77; 149/109.2; 149/109.6

[58] Field of Search ..... 149/17, 61, 77, 149/109.2, 109.6, 19.1, 70

[56] References Cited

U.S. PATENT DOCUMENTS

| | | | |
|---|---|---|---|
| 2,981,616 | 4/1961 | Boyer | 52/5 |
| 3,122,462 | 2/1964 | Kaufman et al. | 149/35 |
| 3,171,249 | 3/1965 | Bell | 548/251 |
| 3,235,558 | 2/1966 | Harrison et al. | 548/251 |
| 3,557,285 | 1/1971 | Enkoji et al. | 548/251 |
| 3,674,059 | 7/1972 | Stephenson | 141/4 |
| 3,719,604 | 3/1973 | Prior et al. | 252/186 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 11/1973 | Marshall | 252/188.3 |
| 3,778,084 | 12/1973 | Sutherland et al. | 280/150 AB |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | McLeod | 102/70.2 |
| 3,806,461 | 4/1974 | Hendrickson et al. | 252/188.3 R |
| 3,833,029 | 9/1974 | Munn | 141/4 |
| 3,833,432 | 9/1974 | Moy et al. | 149/19.3 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,895,235 | 7/1975 | Hamilton et al. | 149/41 |
| 3,902,934 | 9/1975 | Timmerman | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazcale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,947,300 | 3/1976 | Passauer et al. | 149/35 |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kishi et al. | 149/35 |
| 4,062,708 | 12/1977 | Goetz | 149/35 |
| 4,114,591 | 9/1978 | Nakagawa | 126/263 |
| 4,142,029 | 2/1979 | Illy | 521/95 |
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,386,979 | 6/1983 | Jackson, Jr. | 149/21 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,533,416 | 8/1985 | Poole | 149/35 |
| 4,547,235 | 10/1985 | Schneiter et al. | 149/35 |
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,608,102 | 8/1986 | Krampen et al. | 149/92 |

(List continued on next page.)

FOREIGN PATENT DOCUMENTS

| | | | |
|---|---|---|---|
| 0519485A1 | 12/1992 | European Pat. Off. | C06D 5/06 |
| 426343 | 3/1926 | Germany | 251/548 |
| 285080 | 4/1929 | United Kingdom | 251/548 |

OTHER PUBLICATIONS

Declaration of Inventor Gary K. Lund, Oct. 18, 1994.

W. P. Norris and R. A. Henry, "Cyanoguanyl Azide Chemistry," Mar. pp. 650–660, 1964.

"5–Aminotetrazole," *10–Organic Chemistry,* vol. 23, pp. 4471, 1929.

R. Stollé et al., "Zur Kenntnis des Amino–5–tetrazols," *Chem. Ber.,* vol. 62, pp. 1118–1127, 1929.

*Primary Examiner*—Donald P. Walsh
*Assistant Examiner*—John R. Hardee
*Attorney, Agent, or Firm*—Madson & Metcalf; Ronald L. Lyons

[57] ABSTRACT

A solid composition for generating a nitrogen containing gas is provided. The composition includes an oxidizer and a 5-aminotetrazole fuel selected from anhydrous 5-aminotetrazole derivatives, salts, complexes, and mixtures thereof. The salts and complexes are generally metal salts and complexes. The metal can be a transition metal. Metals that have been found to be particularly useful include copper, boron, cobalt, zinc, potassium, sodium, and strontium. The oxidizer is generally a metal oxide or a metal hydroxide. The composition can include certain other components such as secondary oxidizers, burn rate modifiers, slag formers, and binders.

20 Claims, 1 Drawing Sheet

U.S. PATENT DOCUMENTS

| | | | |
|---|---|---|---|
| 4,636,705 | 9/1987 | Hamilton | 149/21 |
| 4,664,033 | 5/1987 | Burkdoll et al. | 102/275.2 |
| 4,698,107 | 10/1987 | Goetz et al. | 149/7 |
| 4,699,400 | 10/1987 | Adams et al. | 280/731 |
| 4,734,141 | 3/1988 | Cartwright et al. | 149/35 |
| 4,758,287 | 7/1988 | Pietz | 149/2 |
| 4,798,142 | 1/1989 | Canterberry et al. | 102/290 |
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schneiter | 280/741 |
| 4,909,549 | 3/1990 | Poole et al. | 280/738 |
| 4,919,897 | 4/1990 | Bender et al. | 422/165 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,004,586 | 4/1991 | Hayashi et al. | 422/164 |
| 5,005,486 | 4/1991 | Lenzen | 102/531 |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 280/741 |
| 5,033,390 | 7/1991 | Minert et al. | 102/530 |
| 5,033,887 | 7/1991 | Unterforsthuber | 102/531 |
| 5,035,757 | 7/1991 | Poole | 149/46 |
| 5,043,030 | 8/1991 | Ramaswany | 149/16 |
| 5,046,429 | 9/1991 | Swann et al. | 102/530 |
| 5,052,817 | 11/1991 | Bement et al. | 374/8 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,084,118 | 1/1992 | Poole | 149/22 |
| 5,089,069 | 2/1992 | Ramaswamy et al. | 149/21 |
| 5,098,597 | 3/1992 | Rothgery et al. | 252/182.34 |
| 5,104,466 | 4/1992 | Allard et al. | 149/21 |
| 5,139,588 | 8/1992 | Poole | 149/61 |
| 5,197,758 | 3/1993 | Lund et al. | 280/741 |
| 5,212,343 | 5/1993 | Brupbacher et al. | 102/323 |

ANHYDROUS 5-AMINOTETRAZOLE GAS GENERANT COMPOSITIONS AND METHODS OF PREPARATION

RELATED APPLICATION

The present application is a continuation-in-part of copending application Ser. No. 08/101,396 now allowed, filed Aug. 2, 1993 and entitled "BITETRAZOLEAMINE GAS GENERANT COMPOSITIONS AND METHODS OF USE," which application is incorporated herein by this reference.

FIELD OF THE INVENTION

The present invention relates to novel gas generating compositions for inflating automobile air bags and similar devices. More particularly, the present invention relates to the use of substantially anhydrous aminotetrazole (5-aminotetrazole) as a primary fuel in gas generating pyrotechnic compositions, and to methods of preparation of such compositions.

BACKGROUND OF INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, NOx, SOx, and hydrogen sulfide.

The automobile manufacturers have also specified that the gas be generated at a sufficiently and reasonably low temperature so that the occupants of the car are not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1,000 psi, and preferably in the range of from about 1.0 ips to about 1.2 ips at 1,000 psi, are generally desired, Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. These features are undesirable aspects of the present sodium azide materials, but are presently tolerated in the absence of an acceptable alternative.

In addition to producing limited, if any, quantities of particulates, it is desired that at least the bulk of any such particulates be easily filterable. For instance, it is desirable that the composition produce a filterable, solid slag. If the solid reaction products form a stable material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have also been proposed as possible gas generants. Such gas generant compositions include oxidizers and fuels which react at sufficiently high rates to produce large quantities of gas in a fraction of a second.

At present, sodium azide is the most widely used and accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, sodium azide combustion products can also be toxic since molybdenum disulfide and sulfur are presently the preferred oxidizers for use with sodium azide. The reaction of these materials produces toxic hydrogen sulfide gas, corrosive sodium oxide, sodium sulfide, and sodium hydroxide powder. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags in demolished cars, The sodium azide remaining in such supplemental restraint systems can leach out of the demolished car to become a water pollutant or toxic waste. Indeed, some have expressed concern that sodium azide, when contacted with battery acids following disposal, forms explosive heavy metal azides or hydrazoic acid.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with each of the selection criteria set forth above.

One group of chemicals that has received attention as a possible replacement for sodium azide includes tetrazoles and triazoles. These materials are generally coupled with conventional oxidizers such as $KNO_3$ and $Sr(NO_3)_2$. Some of the tetrazoles and triazoles that have been specifically mentioned include 5-aminotetrazole, 3-amino-1,2,4-triazole, 1,2,4-triazole, 1H-tetrazole, bitetrazole and several others. However, because of poor ballistic properties and/or high gas temperatures, none of these materials has yet gained general acceptance as a sodium azide replacement.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advancement in the art to provide compositions capable of generating large quantities of gas that would overcome the problems identified in the existing art. It would be a further advancement to provide gas generating compositions which are based on substantially nontoxic starting materials and which produce substantially nontoxic reaction products. It would be another advancement in the art to provide gas generating compositions which produce limited particulate debris and limited undesirable gaseous products. It would also be an advancement in the art to provide gas generating compositions which form a readily filterable solid slag upon reaction.

Such compositions and methods for their use are disclosed and claimed herein.

SUMMARY AND OBJECTS OF THE INVENTION

The novel solid compositions of the present invention include a non-azide fuel and an appropriate oxidizer. Specifically, the present invention is based upon the discovery that improved gas generant compositions are obtained using substantially anhydrous 5-aminotetrazole, or a salt or a complex thereof, as a non-azide fuel. The compositions of the present invention are useful in supplemental restraint systems, such as automobile air bags.

It will be appreciated that 5-aminotetrazole generally takes the monohydrate form. However, gas generating compositions based upon hydrated tetrazoles have been observed to have unacceptably low burning rates. Accordingly, the present invention is related to the use of 5-aminotetrazole in its anhydrous or substantially anhydrous form.

The methods of the present invention teach manufacturing techniques whereby the processing problems encountered in the past can be minimized. In particular, the present invention relates to methods for preparing acceptable gas generating compositions using anhydrous 5-aminotetrazole. In one embodiment, the method entails the following steps:

(a) obtaining a desired quantity of gas generating material, said gas generating material comprising an oxidizer and hydrated 5-aminotetrazole;

(b) preparing a slurry of said gas generating material in water;

(c) drying said slurried material to a constant weight;

(d) pressing said material into pellets in hydrated form; and (e) drying said pellets such that the gas generating material is in anhydrous or substantially anhydrous form.

Importantly, the methods of the present invention provide for pressing of the material while still in the hydrated form. Thus, it is possible to prepare acceptable gas generant pellets. If the material is pressed while in the anhydrous form, the pellets are generally observed to powder and crumble, particularly when exposed to a humid environment.

Following pressing of the pellets, the gas generating material is dried until the tetrazole is substantially anhydrous. Generally, the hydrated 5-aminotetrazole composition loses about 3% to 5% of its weight during the drying process. The 5-aminotetrazole itself loses about 17% of its weight (theoretical weight loss is 17.5%). This is found to occur, for example, after drying at 110° C. for 12 hours. A material in this state can be said to be anhydrous for purposes herein. Of course the precise temperature and length of time of drying is not critical to the practice of the invention, but it is presently preferred that the temperature not exceed 150° C. FIG. 1 illustrates a typical 5-aminotetrazole drying curve at 35° C.

Pellets prepared by this method are observed to be robust and maintain their structural integrity when exposed to humid environments. In general, pellets prepared by the preferred method exhibit crush strengths in excess of 10 lb load in a typical configuration (⅜ inch diameter by 0.07 inches thick). This compares favorably to those obtained with commercial sodium azide generant pellets of the same dimensions, which typically yield crush strengths of 5 lb to 15 lb load.

The present compositions are capable of generating large quantities of gas while overcoming various problems associated with conventional gas generating compositions. The compositions of the present invention produce substantially nontoxic reaction products. The present compositions are particularly useful for generating large quantities of a nontoxic gas, such as nitrogen gas. Significantly, the present compositions avoid the use of azides, produce no sodium hydroxide by-products, generate no sulfur compounds such as hydrogen sulfide and sulfur oxides, and still produce a nitrogen containing gas.

The compositions of the present invention also produce only limited particulate debris, provide good slag formation and substantially avoid, if not avoid, the formation of nonfilterable particulate debris. At the same time, the compositions of the present invention achieve a relatively high burn rate, while producing a reasonably low temperature gas. Thus, the gas produced by the present invention is readily adaptable for use in deploying supplemental restraint systems, such as automobile air bags.

DETAILED DESCRIPTION OF THE INVENTION

Figure 1:
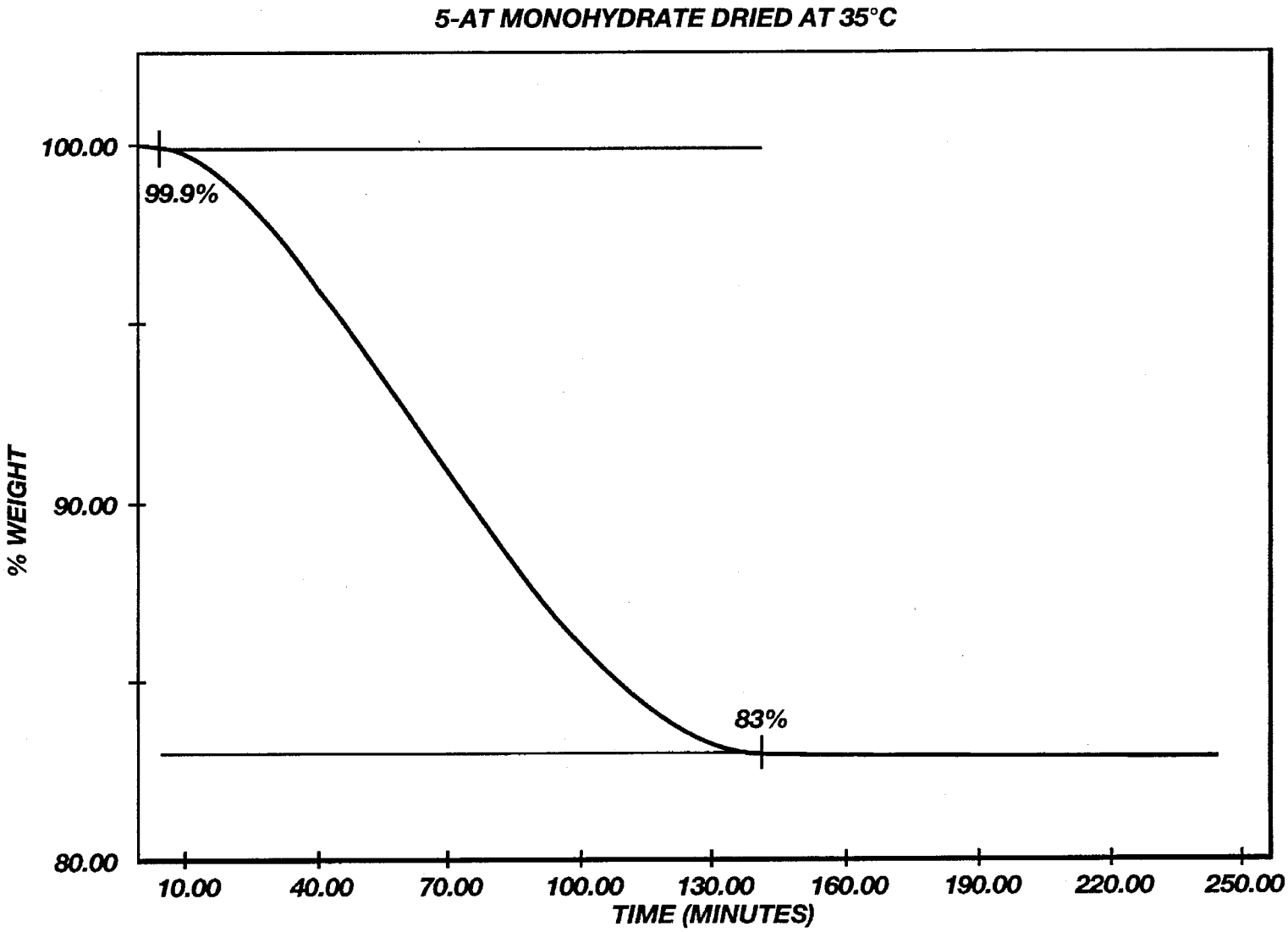
FIG. 1 is a graph of a drying curve for 5-aminotetrazole at 35° C.

The present invention relates to the use of substantially anhydrous 5-aminotetrazole (sometimes referred to herein as "5-AT"), or a salt or a complex thereof, as the primary fuel in a novel gas generating composition. As used herein, substantially anhydrous 5-aminotetrazole is defined as hydrated 5-AT which has lost not less than about 14% of its weight during drying and more preferably about 17% of its weight during drying. The salts or complexes of 5-aminotetrazole may including, for example, those of transition metals such as copper, cobalt, iron, titanium, and zinc; alkali metals such as potassium and sodium; alkaline earth metals such as strontium, magnesium, and calcium; boron; aluminum; and nonmetallic cations such as ammonium, hydroxylammonium, hydrazinium, guanidinium, aminoguanidinium, diaminoguanidinium, triaminoguanidinium, or biguanidinium.

In the compositions of the present invention, the fuel is paired with an appropriate oxidizer. Inorganic oxidizing agents are preferred because they produce a lower flame temperature and an improved filterable slag. Such oxidizers include metal oxides and metal hydroxides. Other oxidizers include metal nitrates, metal nitrites, metal chlorates, metal perchlorates, metal peroxides, ammonium nitrate, ammonium perchlorate and the like. The use of metal oxides or hydroxides as oxidizers is particularly useful and such materials include for instance, the oxides and hydroxides of copper, cobalt, manganese, tungsten, bismuth, molybdenum, and iron, such as CuO, $Co_2O_3$, $Fe_{20}O_3$, $MoO_3$, $Bi_2MoO_6$, $Bi_2O_3$, and $Cu(OH)_2$. The oxidizer may also be a mixture of the above-referenced oxidizing agents, or the above-referenced oxidizing agents and other oxidizing agents. For example, the oxide and hydroxide oxidizing agents mentioned above can, if desired, be combined with other conventional oxidizers such as $Sr(NO_3)_2$, $NH_4ClO_4$, and $KNO_3$, for a particular application, such as, for instance, to provide increased flame temperature or to modify the gas product yields.

A presently preferred oxidizer is cupric oxide. It has been found that gas generant compositions prepared from pyrometallurgical grade cupric oxide produce faster burn rates compared to hydrometallurgical grade cupric oxide. In addition, faster burn rates have been observed with ground cupric oxide compared to unground cupric oxide. An average oxidizer particle size of less than about 4 microns is presently preferred.

The 5-AT fuel is combined, in a fuel-effective amount, with an appropriate oxidizing agent to obtain a gas generating composition. In a typical formulation, the tetrazole fuel comprises from about 10 to about 50 weight percent of the composition and the oxidizer comprises from about 50 to about 90 weight percent thereof. More particularly, a composition can comprise from about 15 to about 35 weight percent fuel and from about 60 to about 85 weight percent oxidizer.

An example of the reaction between the anhydrous tetrazole and the oxidizer is as follows:

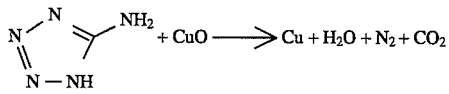

The present compositions can also include additives conventionally used in gas generating compositions, propellants, and explosives, such as binders, burn rate modifiers, slag formers, release agents, and additives which effectively remove $NO_x$. Typical binders include lactose, boric acid, silicates including magnesium silicate, polypropylene carbonate, polyethylene glycol, and other conventional polymeric binders. Typical burn rate modifiers include $Fe_2O_3$, $K_2B_{12}H_{12}$, $Bi_2MoO_6$, and graphite carbon fibers.

A number of slag forming agents are known and include, for example, clays, talcs, silicon oxides, alkaline earth oxides, hydroxides, oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, calcium stearate, or boron nitride.

The present compositions produce stable pellets. This is important because gas generants in pellet form are generally used for placement in gas generating devices, such as automobile supplemental restraint systems. Gas generant pellets should have sufficient crush strength to maintain their shape and configuration during normal use and withstand loads produced upon ignition since pellet failure results in uncontrollable internal ballistics.

The present invention relates specifically to the preparation of anhydrous 5-AT gas generant compositions. Anhydrous 5-AT compositions produce advantages over the hydrated form. For example, a higher (more acceptable) burn rate is generally observed. At the same time, the methods of the present invention allow for pressing the composition in the hydrated form such that pellets with good integrity are produced.

As discussed above, a gas generating composition comprises anhydrous 5-AT coupled with an acceptable oxidizer. At the stage of formulating the composition, the 5-aminotetrazole may be in the hydrated form which is generally available as a monohydrate. The components of the gas generant are mixed, for example by dry blending.

A water slurry of the gas generant composition is then preferably prepared. Generally the slurry comprises from about 3% to about 40% water by weight, with the remainder of the slurry comprising the gas generating composition. Although other materials may be used to prepare the slurry, such as ethanol and methanol, water is presently preferred. The slurry will generally have a paste-like consistency, although under some circumstances a damp powder consistency is desirable.

The mixture is then dried to a constant weight. This preferably takes place at a temperature less than about 110° C., and preferably less than about 45° C. For instance, a 5-AT/CuO composition mixture will generally establish an equilibrium moisture content in the range of from about 3% to about 5%, with the 5-AT being in the hydrated form (typically monohydrated). 5-AT monohydrate has a moisture content of approximately 17%.

Next, the material is pressed into pellet form in order to meet the requirements of the specific intended end use. As mentioned above, pressing the pellets while the 5-AT is hydrated results in a better pellet. In particular, crumbling of the material after pressing and upon exposure to ambient humidities is substantially avoided. It will be appreciated that if the pellet crumbles it generally will not burn in the manner required by automobile air bag systems.

After pressing the pellet, the material is dried such that the composition becomes anhydrous or substantially anhydrous. For instance, the above mentioned 5-AT/CuO material typically loses between 3% and 5% by weight water during this transition to the anhydrous state. It is found to be acceptable if the material is dried for a period of about 12 hours at about 110° C., or until the weight of the material stabilizes as indicated by no further weight loss at the drying temperature. For the purposes of this application, the material in this condition will be defined as "anhydrous."

Following drying it may be preferable to protect the material from exposure to moisture, even though the material in this form has not been found to be unduly hygroscopic at humidities below 20% Rh at room temperature. Thus, the pellet may be placed within a sealed container, or coated with a water impermeable material.

One of the important advantages of the anhydrous 5-AT gas generating compositions of the present invention, is that they are stable and combust to produce sufficient volumes of substantially nontoxic gas products. 5-AT has also been found to be safe when subjected to conventional impact, friction, electrostatic discharge, and thermal tests.

These anhydrous 5-AT compositions also are prone to form slag, rather than particulate debris. This is a further significant advantage in the context of gas generants for automobile air bags.

An additional advantage of an anhydrous 5-AT fueled gas generant composition is that the burn rate performance is good. As mentioned above, burn rates above 0.5 inch per second (ips) are preferred. Burn rates in these ranges are achievable using the compositions and methods of the present invention.

Anhydrous 5-AT compositions compare favorably with sodium azide compositions in terms of burn rate as illustrated in Table 1.

TABLE 1

| Gas Generant | Burn Rate at 1000 psi | Relative Vol. Gas Per Vol. Generant |
|---|---|---|
| Sodium azide (baseline) | 1.2 ± 0.1 ips | 0.97 |
| Sodium azide low sulfur | 1.3 ± 0.2 ips | 1.0 |
| Anhydrous 5-AT/CuO | 0.75 ± 0.05 ips | 1.2 |

An inflatable restraining device, such as an automobile air bag system comprises a collapsed, inflatable air bag, a means for generating gas connected to that air bag for inflating the air bag wherein the gas generating means contains a nontoxic gas generating composition which comprises a fuel and an oxidizer therefor wherein the fuel comprises anhydrous S-AT or a salt or complex thereof.

Suitable means for generating gas include gas generating devices which are used in supplemental safety restraint systems used in the automotive industry. The supplemental safety restraint system may, if desired, include conventional screen packs to remove particulates, if any, formed while the gas generant is combusted.

The present invention is further described in the following non-limiting examples.

EXAMPLES

EXAMPLE 1

Gas generating compositions were prepared utilizing 5-aminotetrazole as the fuel. Commercially obtained 5-aminotetrazole monohydrate was recrystallized from ethanol, dried in vacuo (1 mm Hg) at 170° F. for 48 hours and mechanically ground to a fine powder. Cupric oxide (15.32 g, 76.6%) and 4.68 g (23.4%) of the dried 5-aminotetrazole were slurried in 14 grams of water and then dried in vacuo (1 mm Hg) at 150° F. to 170° F. until the moisture content was approximately 25% of the total generant weight. The resulting paste was forced through a 24 mesh screen to granulate the mixture, which was further dried to remove the remaining moisture. A portion of the resulting dried mixture was then exposed to 100% relative humidity at 170° F. for 24 hours during which time 3.73% by weight of the moisture was absorbed. The above preparation was repeated on a second batch of material and resulted in 3.81% moisture being retained.

Pellets of each of the compositions were pressed and tested for burning rate and density. Burning rates of 0.799 ips at 1,000 psi were obtained for the anhydrous composition, and burning rates of 0.395 ips at 1,000 psi were obtained for the hydrated compositions. Densities of 3.03 g/cc and 2.82 g/cc were obtained for the anhydrous and hydrated compositions respectively. Exposure of pellets prepared from the anhydrous condition to 45% and 60% Rh at 70° F. resulted in complete degradation of pellet integrity within 24 hours.

EXAMPLE 2

In this example compositions within the scope of the invention were prepared. The compositions comprised 76.6% CuO and 23.4% 5-aminotetrazole. In one set of compositions, the 5-aminotetrazole was received as a coarse material. In the other set of compositions, the 5-aminotetrazole was recrystallized from ethanol and then ground.

A water slurry was prepared using both sets of compositions. The slurry comprised 40% by weight water and 60% by weight gas generating composition. The slurry was mixed until a homogenous mixture was achieved.

The slurry was dried in air to a stable weight and then pressed into pellets. Four pellets of each formulation were prepared and tested. Two pellets of each composition were dried at 110° C. for 18 hours and lost an average of 1.5% of their weight.

Burn rate was determined at 1,000 psi and the following results were achieved:

| Sample | Burn Rate (ips) (ips @ 1000 psi) | Density (gm/cc) |
|---|---|---|
| Coarse 5-AT/no post drying | 0.620 | 2.95 |
| Coarse 5-AT/post drying | 0.736 | 2.94 |
| Fine 5-AT/no post drying | 0.639 | 2.94 |
| Fine 5-AT/post drying | 0.690 | 2.93 |

Overall, improved results were observed using the post drying method of the present invention.

EXAMPLE 3

Commercially obtained 5-aminotetrazole monohydrate was prepared to be utilized as a fuel for use in gas generant compositions. Approximately five pounds of aminotetrazole monohydrate (Aldrich) was ground in a fluid energy mill. Using a Microtrac Standard Range Particle Analyzer it was determined that 10% of the resulting fuel particles had a diameter less than 2.2 microns and that 50% of the fuel particles had a diameter less than 5.6 microns. The ground aminotetrazole hydrate was dried at 220 F for at least four hours. A weight loss of approximately 14% was observed. The resulting anhydrous aminotetrazole powder was forced through a 60 mesh sieve before use.

EXAMPLE 4

Three gas generating compositions were prepared utilizing the anhydrous 5-aminotetrazole powder from Example 3 as the fuel and three different types of cupric oxide as the oxidizer. The three types of cupric oxide were obtained from the American Chemet Corporation. They consisted of a ground cupric oxide of pyrometallurgical origin (grd pyro) with a mean particle size of 3.6 microns, a cupric oxide of hydrometallurgical origin (ungrd hydro) with a mean particle size of 9.5 microns, and a ground cupric oxide of hydrometallurgical origin (grd hydro) with a mean particle size of 3.6 microns. The respective cupric oxide (22.98 g, 76.60%) was stirred into 7.02 g (23.40%) of the aminotetrazole, the composition was shaken in an enclosed container for approximately two minutes and then slurried with 12 g of water. The three compositions were dried overnight at 73° F., and granulated through an 18 mesh sieve. Samples therefrom were pressed into ½" diameter cylindrical pellets with a weight of three grams each. The resulting burn rate data are summarized in Table 2. The burn rates were a function of the type of cupric oxide used as the oxidizer and increased in the burn rate as follows: ungrd hydro<<grd hydro<grd pyro.

EXAMPLE 5

Samples of granules prepared according to the procedure of Example 4 were dried further at 220° F. The accompanying weight losses are summarized in Table 2. Samples of the 5-AT/CuO composition were pressed into ½" diameter cylindrical pellets with a weight of three grams each. The resulting burn rate data are summarized in Table 2. The burn rates were a function of the type of cupric oxide used as the oxidizer and increased in burn rate as follows: ungrd hydro<<grd hydro<grd pyro. The burn rates were about twice as high as those obtained for pellets derived from granules dried at 73° F. as described in Example Samples of the granules prepared in Example 4 that were dried at 220° F. were pressed into ½" diameter cylindrical pellets with a weight of one gram each. These pellets were placed in a humidity chamber held at 60% humidity. Over a period of 67 hours, the pellets had gained between 3.7 and 4.3% of their original weight and were seriously delaminated with several large circumferential cracks.

EXAMPLE 6

Samples of granules prepared according to the procedure of Example 4 were pressed into ½" diameter cylindrical pellets with a weight of three grams each. The pellets were dried overnight at 220° F. The accompanying weight losses are reported in Table 2 as well as the resulting burn rate data. The burn rates were a function of the type of cupric oxide used as the oxidizer and increased in burn rate as follows: ungrd hydro<<grd hydro<grd pyro. Furthermore, the burn rates are consistently higher than those of the corresponding pellets prepared as in Example 5. A sample of granules prepared in Example 4 were pressed into ½" diameter cylindrical pellets with a weight of one gram each. These pellets were dried at 220° F. and then placed in a humidity chamber held at 60% humidity. Over a period of 67 hours, the pellets gained between 4.2 and 4.5% of their original weight. These pellets appeared to be unchanged and showed no signs of cracking or delamination. Pellets processed by this method appear to be much more robust under conditions of high humidity than those prepared by the method of Example 5.

EXAMPLE 7

A gas generating composition was prepared utilizing anhydrous 5-aminotetrazole powder from Example 3 as the fuel. The grd pyro cupric oxide described in Example 4 (22.98 g, 76.60%) was stirred into 7.02 g (23.40%) of the aminotetrazole. The composition was shaken in an enclosed container for approximately two minutes. However, this particular sample was not slurried in water or any other solvent. The resulting powder was pressed into ½" diameter cylindrical pellets with a weight of three grams each. The resulting burn rate data are summarized in Table 2. The burn rate of the composition was significantly lower than that of the corresponding grd pyro composition which was slurried in water and dried at 220° F. as pellets. One gram pellets of this material gained 4.7% of their original weight over a period of 67 hours in an atmosphere containing 60% humidity. In addition, pellets of this material delaminated during this humidity aging.

EXAMPLE 8

A composition containing aminotetrazole from Example 3 (23.40 g, 23.40%) and the grd pyro cupric oxide described in Example 4 (76.60 g, 76.60%) was mixed and dried as in Example 4. Three gram pellets were produced according to procedures in Examples 4, 5, and 6, respectively. The burn rate data obtained from the 100 g mix are summarized in Table 2. Again, pellets produced from the completely dried granules delaminated, while pellets pressed from slightly moist granules and then dried as pellets remained intact during humidity aging.

EXAMPLE 9

A crystalline sample of aminotetrazole hydrate (Dynamit Nobel) was dehydrated at 220° F. losing 17.1% of it original weight (17.5% being theoretical weight loss). A portion of this anhydrous aminotetrazole was recrystallized from methanol and an additional portion was recrystallized from ethanol. The resulting solids were heated at 220° F. to a constant weight. Each type of aminotetrazole was forced through a 60 mesh sieve. Three compositions containing grd pyro cupric oxide (38.30 g, 76.60%) and aminotetrazole (11.70 g, 23.40%) were mixed and processed in the solvent from which the aminotetrazole was last crystallized: water, methanol and ethanol, respectively. The cupric oxide and aminotetrazole were dry blended and mixed by shaking, followed by slurrying in 19 g, 11 g and 13 g of water, methanol an ethanol, respectively. The mixes were dried partially, granulated, dried completely, and then allowed to take up solvent in solvent-saturated air over a three day period. The formulations gained 3.6%, 2.1%, and 1.1% water, methanol and ethanol, respectively. Pellets were pressed from −18 mesh solvated granules. The pellets lost 4.2%, 0.6%, and 0.2% of their weight upon drying at 220° F. Burn rate data are summarized in Table 2. Burn rate for pellets derived from water-processing are significantly higher than those derived from alcohol processing.

TABLE 2

Cupric Oxide/Aminotetrazole Formulations*
Burn Rate Variations with Processing and Cupric Oxide Grade

| Example Number | CuO Grade | Mix Size (gm) | Slurry Media | Final Dry Form | Final Dry Temp. | Final Dry Wt. Loss | Pellets in Humidity | Rb (in/s) at $P_{ave}$ (psi) |
|---|---|---|---|---|---|---|---|---|
| Ex. 4 | grd pyro | 30 | water | granules | 73° F. | NA | NA | 0.329 at 1058 |

TABLE 2-continued

Cupric Oxide/Aminotetrazole Formulations*
Burn Rate Variations with Processing and Cupric Oxide Grade

| Example Number | CuO Grade | Mix Size (gm) | Slurry Media | Final Dry Form | Final Dry Temp. | Final Dry Wt. Loss | Pellets in Humidity | Rb (in/s) at $P_{ave}$ (psi) |
|---|---|---|---|---|---|---|---|---|
| Ex. 4 | grd hydro | 10 | water | granules | 73° F. | NA | NA | 0.309 at 1086 |
| Ex. 4 | ungrd hydro | 30 | water | granules | 73° F. | NA | NA | 0.229 at 1120 |
| Ex. 5 | grd pyro | 30 | water | granules | 220° F. | 5.3% | crumbled | 0.711 at 1078 |
| Ex. 5 | grd hydro | 30 | water | granules | 220° F. | 6.0% | crumbled | 0.634 at 1073 |
| Ex. 5 | ungrd hydro | 30 | water | granules | 220° F. | 7.4% | crumbled | 0.497 at 1071 |
| Ex. 6 | grd pyro | 30 | water | pellets | 220° F. | 5.3% | intact | 0.787 at 1069 |
| Ex. 6 | grd hydro | 30 | water | pellets | 220° F. | 4.8% | intact | 0.731 at 1071 |
| Ex. 6 | ungrd hydro | 30 | water | pellets | 220° F. | 6.0% | intact | 0.537 at 1064 |
| Ex. 7 | grd pyro | 30 | dry | powder | NA | NA | crumbled | 0.565 at 1069 |
| Ex. 8 | grd pyro | 100 | water | granules | 73° F. | NA | NA | 0.325 at 1063 |
| Ex. 8 | grd pyro | 100 | water | granules | 220° F. | 4.6% | crumbled | 0.735 at 1069 |
| Ex. 8 | grd pyro | 100 | water | granules | 220° F. | 4.7% | intact | 0.815 at 1066 |
| Ex. 9 | grd pyro | 50 | water | pellets | 220° F. | 4.25% | NA | 0.757 at 1065 |
| Ex. 9 | grd pyro | 50 | methanol | pellets | 220° F. | 0.64% | NA | 0.537 at 1069 |
| Ex. 9 | grd pyro | 50 | ethanol | pellets | 220° F. | 0.16% | NA | 0.540 at 1125 |

*76.60% cupric oxide, 23.40% anhydrous aminotetrazole.

EXAMPLE 10

A gas generating composition consisting of 55.78% (11.16 g) grd pyro cupric oxide as described in Example 4, 26.25% (5.25 g) of the 5.6 micron, partially dehydrated aminotetrazole (AT●0.8$H_2O$) described in Example 3, and 17.96% (3.59 g) of a ground sample of strontium nitrate was slurried with five grams of water and dried at 135° F. to a constant weight. Pellets were pressed from a portion of this gas generant material exhibiting a pellet density of 2.8 g/cc and a burn rate of 0.886 ips at $P_{ave}$ of 1119 psi. Additional generant was dried further at 220° F. with a corresponding weight loss of 2%. The density of pellets therefrom remained at 2.8 g/cc while the burn rate increased to 0.935 ips at a $P_{ave}$ of 1103 psi. The theoretical flame temperature of the anhydrous formulation is 1825° K.

EXAMPLE 11

Three gas generating compositions were prepared utilizing the anhydrous 5-aminotetrazole powder prepared in Example 3 as the fuel (21.24%, 10.62 g), the three different types of cupric oxide described in Example 4, as the oxidizer (54.72%, 27.36 g), and ground strontium nitrate as the co-oxidizer (24.04%, 12.02 g). The formulation was mixed, slurried, dried, and granulated according to the procedure in Example 4, with a drying temperature of 122° F. Pellets were formed and processed similarly to those described in Example 4, 5, and 6. The results are summarized in Table 3. As with the cupric oxide/aminotetrazole formulations, burn rate values are dependent on the type of cupric oxide and follow the same trend: ungrd hydro<<grd hydro<grd pyro. Pellets from hydrated granules exhibit a lower burn rate than pellets derived from granules dried at 220° F. or from pellets dried at 220° F. The latter two types of pellets have comparable burn rates. This may be due in part to the fact that the weight loss from the hydrated compositions is much smaller than for the cupric oxide/aminotetrazole series of compositions in Example 4–6. One gram pellets that were formed and processed similarly to those of Examples 4–6, were placed in closed chamber with 60% humidity. After aging for 90 hours, weight gains of 3–4.5% were observed. Furthermore, all of the pellets showed signs of delamination except for the pellets containing the grd pyro cupric oxide that had been dried in the pellet form (See, Table 3). The granules of this particular mix had been pressed with the highest moisture content.

TABLE 3

Cupric Oxide/Strontium Nitrate/Aminotetrazole Formulations*
Burn Rate Variations with Processing and Cupric Oxide Grade

| Example Number | CuO Grade | Mix Size (gm) | Slurry Media | Final Dry Form | Final Dry Temp. | Final Dry Wt. Loss | Pellets in Humidity | Rb (in/s) at $P_{ave}$ (psi) |
|---|---|---|---|---|---|---|---|---|
| Ex. 11 | grd pyro | 50 | water | granules | 122° F. | NA | NA | 0.793 at 1124 |
| Ex. 11 | grd hydro | 50 | water | granules | 122° F. | NA | NA | 0.753 at 1101 |
| Ex. 11 | ungrd hydro | 50 | water | granules | 122° F. | NA | NA | 0.655 at 1120 |
| Ex. 11 | grd pyro | 50 | water | granules | 220° F. | 1.6% | crumbled | 0.986 at 1117 |
| Ex. 11 | grd hydro | 50 | water | granules | 220° F. | 0.7% | crumbled | 0.758 at 1116 |
| Ex. 11 | ungrd hydro | 50 | water | granules | 220° F. | 0.6% | crumbled | 0.736 at 1115 |
| Ex. 11 | grd pyro | 50 | water | granules | 220° F. | 1.9% | intact | 0.950 at 1117 |
| Ex. 11 | grd hydro | 50 | water | granules | 220° F. | 0.9% | crumbled | 0.772 at 1101 |
| Ex. 11 | ungrd hydro | 50 | water | granules | 220° F. | 0.7% | crumbled | 0.678 at 1116 |

*54.72% cupric oxide, 24.04 strontium nitrate, 21.24% anhydrous aminotetrazole.

EXAMPLE 12

A gas generating composition was prepared utilizing anhydrous 5-aminotetrazole powder (9.86%, 0.54 g, Fairmont), 8.7 micron ungrd hydro cupric oxide (55.30%, 3.04 g, Aldrich) as the oxidizer, ground strontium nitrate as the co-oxidizer (24.52%, 1.35 g), and sodium dicyanamide (NaDCA) as a ballistic modifier (10.32%, 0.57 g Aldrich Lot). The formulation was mixed as a water slurry, dried completely and pressed into pellets. The burn rate was 0.567 ips at $P_{ave}$ of 1055 psi with a calculated flame temperature of 1589° K.

EXAMPLE 13

A gas generating composition was prepared utilizing anhydrous 5-aminotetrazole powder (12.64%, 1.27 g, Fairmont), 8.7 micron ungrd hydro cupric oxide (31.52%, 3.15 g, Aldrich) as the cooxidizer, ground strontium nitrate as the oxidizer (42.59%, 4.26 g), and sodium dicyanamide as a ballistic modifier (13.23%, 1.32 g, Aldrich Lot). The formulation was mixed as a water slurry, dried completely, and pressed into pellets. The burn rate was 0.817 ips with a $P_{ave}$ of 1096 psi. The theoretical flame temperature is 1972° K. Mixes producing the fastest burn rate are summarized in Table 4 for each of the formulation types described in the above examples.

TABLE 4

Cupric Oxide, Aminotetrazole Formulations
Effect of Additives on Burn Rate

| Example Number | Formulation | Mix Size (gm) | Flame Temp. (°K.) | Density (g/cc) | Weight % Gas | Rb (in/s) at $P_{ave}$ (psi) |
|---|---|---|---|---|---|---|
| Ex. 8 | 23.40% AT<br>76.60% CuO | 100 | 1576 | 2.95 | 39 | 0.815 at 1066 |
| Ex. 11 | 21.24% AT<br>54.72% CuO<br>24.04% $Sr(NO_3)_2$ | 50 | 1737 | 2.86 | 39 | 0.950 at 1117 |
| Ex. 10 | 23.34% AT<br>57.99% CuO<br>18.67% $Sr(NO_3)_2$ | 20 | 1825 | 2.83 | 41 | 0.935 at 1103 |
| Ex. 12 | 9.86% AT<br>55.31% CuO<br>24.52% $Sr(NO_3)_2$<br>10.31% NaDCA | 5.5 | 1589 | 3.11 | 34 | 0.567 at 1055 |
| Ex. 13 | 12.64% AT<br>31.53% CuO<br>42.60% $Sr(NO_3)_2$<br>13.23% NaDCA | 10 | 1972 | 2.58 | 45 | 0.817 at 1096 |

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A gas generating composition comprising a fuel selected from the group consisting of anhydrous 5-aminotetrazole, anhydrous salts thereof, anhydrous complexes thereof, and mixtures thereof, and an oxidizer, said oxidizer being selected from the group consisting of metal oxides, metal hydroxides, metal nitrates, metal nitrites, metal chlorates, metal perchlorates, metal peroxides, ammonium nitrate, ammonium perchlorate, and mixtures thereof.

2. A gas generating composition as defined in claim 1, wherein said oxidizer is a metal oxide or metal hydroxide.

3. A gas generating composition as defined in claim 2, wherein said metal oxide or metal hydroxide is a transition metal oxide or metal hydroxide.

4. A gas generating composition as defined in claim 1, wherein said oxidizer is an oxide or hydroxide of a metal selected from the group consisting of copper, molybdenum, bismuth, cobalt and iron.

5. A gas generating composition as defined in claim 1, wherein said oxidizer is cupric oxide.

6. A gas generating composition as defined in claim 1, wherein the oxidizer is pyrometallurgical grade cupric oxide.

7. A gas generating composition as defined in claim 1, wherein the oxidizer is cupric oxide having an average particle size of less than 4 μ.

8. A gas generating composition as defined in claim 1, wherein said fuel is present in an amount ranging from about 10 to about 50 percent by weight, and said oxidizer is present in an amount ranging from about 50 percent to about 90 percent by weight.

9. A gas generating composition as defined in claim 1, wherein said fuel is present in an amount ranging from about 15 to about 35 percent by weight, and said oxidizer is present in an amount ranging from about 60 percent to about 85 percent by weight.

10. A gas generating composition as defined in claim 1, wherein said salt or complex of 5-aminotetrazole is a transition metal salt or complex thereof.

11. A gas generating composition as defined in claim 1, wherein said salt or complex of 5-aminotetrazole is a salt or complex of a metal selected from the group consisting of iron, boron, copper, cobalt, zinc, potassium, sodium, strontium, and titanium.

12. A gas generating composition as defined in claim 1, wherein said gas generating composition further comprises a burn rate modifier.

13. A gas generating composition as defined in claim 1, wherein said gas generating composition further comprises a binder.

14. A gas generating composition as defined in claim 1, wherein said gas generating composition further comprises a slag forming agent.

15. A gas generating composition as defined in claim 1, wherein said gas generating composition further comprises a supplemental oxidizer.

16. A gas generating composition as defined in claim 5, wherein the composition absorbs from about 3.7% to about 3.8% by weight moisture on exposure to 100% relative humidity at 170% for 24 hours.

17. An inflatable restraining device comprising a collapsed, inflatable air bag, means for generating gas connected to that air bag for inflating the air bag wherein the gas generating means contains a nontoxic gas generating composition which comprises a fuel selected from the group consisting of anhydrous 5-aminotetrazole, anhydrous salts thereof, anhydrous complexes thereof and mixtures thereof, and an oxidizer, said oxidizer being selected from the group consisting of metal oxides, metal hydroxides, metal nitrates, metal nitrites, metal chlorates, metal perchlorates, metal peroxides, ammonium nitrate, ammonium perchlorate, and mixtures thereof.

18. A vehicle containing a supplemental restraint system having an air bag system comprising:

a collapsed, inflatable air bag, means for generating gas connected to that air bag for inflating the air bag wherein the gas generating means contains a nontoxic gas generating composition which comprises a fuel selected from the group consisting of anhydrous 5-aminotetrazole, anhydrous salts thereof, anhydrous complexes thereof and mixtures thereof, and an oxidizer, said oxidizer being selected from the group consisting of metal oxides, metal hydroxides, metal nitrates, metal nitrites, metal chlorates, metal perchlorates, metal peroxides, ammonium nitrate, ammonium perchlorate and mixtures thereof.

19. A gas generating composition consisting essentially of anhydrous 5-aminotetrazole, an oxidizer selected from the group consisting of metal oxides and metal hydroxides, and at least one additive selected from the group consisting of binders, burn rate modifiers, slag formers, release agents, and agents which remove $NO_x$ from the produced gas.

20. A pellet prepared by the process comprising the steps of:

(a) obtaining a desired quantity of gas generating material, said gas generating material comprising an oxidizer and hydrated 5-aminotetrazole;

(b) preparing a slurry of said gas generating material in water;

(c) drying said slurried material to a constant weight;

(d) pressing said material into pellets in hydrated form; and (e) drying said pellets such that the gas generating material is in anhydrous or substantially anhydrous form.

* * * * *